United States Patent [19]

Sakurai et al.

[11] Patent Number: 5,035,207

[45] Date of Patent: Jul. 30, 1991

[54] COOLING SYSTEM FOR VEHICLE

[75] Inventors: Kenichi Sakurai, Kami; Kazutoshi Ueda, Iwata, both of Japan

[73] Assignee: Yamaha Hatsudoki Kabushiki Kaisha, Iwata, Japan

[21] Appl. No.: 261,719

[22] Filed: Oct. 24, 1988

Related U.S. Application Data

[62] Division of Ser. No. 914,869, Oct. 3, 1986, Pat. No. 4,790,287.

[30] Foreign Application Priority Data

Oct. 11, 1985 [JP] Japan ..... 60-226287

[51] Int. Cl.[5] ..... F01P 7/14

[52] U.S. Cl. ..... 123/41.1; 123/55 VS

[58] Field of Search ..... 123/41.09, 41.1, 41.29, 123/41.44, 41.74, 55 VE, 55 VS

[56] References Cited

U.S. PATENT DOCUMENTS

| | | | |
|---|---|---|---|
| 2,125,751 | 8/1938 | Saulnier | 123/41.1 |
| 2,536,642 | 1/1951 | Holley | 123/41.09 |
| 2,713,332 | 7/1955 | Beardsley | 123/41.74 |
| 2,936,745 | 5/1960 | Frank | 123/41.29 |
| 3,492,978 | 2/1970 | Baster | 123/55 VE |
| 4,212,270 | 7/1980 | Nakanishi et al. | 123/41.09 |
| 4,312,304 | 1/1982 | Tyner | 123/41.74 |
| 4,413,596 | 11/1983 | Hirayama | 123/41.1 |
| 4,745,885 | 5/1988 | Koinuma | 123/41.44 |

FOREIGN PATENT DOCUMENTS

| | | | |
|---|---|---|---|
| 2613426 | 10/1988 | France | 123/55 VS |
| 285916 | 2/1928 | United Kingdom | 123/41.1 |

OTHER PUBLICATIONS

Ford 1979 Car shop Manual, Engine, vol. 2, pp. 27-0-3-2.

Ford 1981 Car Shop Manual, Escort-Lynx, pp. 27-0-1-2.

*Primary Examiner*—Noah P. Kamen

*Attorney, Agent, or Firm*—Ernest A. Beutler

[57] ABSTRACT

A V type engine embodying an improved oil separator for its crankcase ventilation system. The oil separator is contained within the valley between the banks of cylinders and has a simplified but effective arrangement for achieving separation.

5 Claims, 4 Drawing Sheets

COOLING SYSTEM FOR VEHICLE

This is a division of U.S. patent application Ser. No. 914,868, filed Oct. 3, 1986, now U.S. Pat. No. 4,790,287.

BACKGROUND OF THE INVENTION

This invention relates to an engine cooling system and more particularly to an improved cooling system for V-type engines having a transverse disposition within the engine compartment.

It is well known that V-type engines normally have a coolant pump located at one end of the engine and which delivers coolant to the cooling jackets of the engine at that one end. In addition, a return passage is formed at that same end of the engine for returning coolant to the radiator from the engine cooling jacket. Although this arrangement has certain advantages, it also has some disadvantages. For example, by routing the flow of coolant through the engine from one end to the other and then back, optimum cooling may not result. Furthermore, this type of system has disadvantages in connection with transverse engine placement in the engine compartment. Where the engine is positioned transversely, it may be desirable to avoid having all of the coolant connections to the engine located at one end.

It is, therefore, a principal object of this invention to provide an improved cooling system for an internal combustion engine.

It is a further object of this invention to provide an improved cooling system for engines, particularly to those of the V-type, wherein the water pump is located at one end of the engine and the return from the cooling jacket is located at the other end of the engine.

It is a still further object of this invention to provide an improved cooling jacket arrangement and cooling system for a transversely positioned engine of a motor vehicle.

SUMMARY OF THE INVENTION

This invention is adapted to be embodied in a coolant passage system for an internal combustion engine having a crankshaft, a radiator and a pair of cylinder banks having respective cooling jackets defined therein with a V-shaped space defined between the cylinder banks. In accordance with the invention, a coolant pump is disposed at one end of the cylinder banks in the direction of the cranshaft for delivering coolant into the cooling jackets and a collecting conduit is disposed at an opposite end of the cylinder banks for delivering coolant from the cooling jackets to the radiator. A bypass pipe interconnects the coolant pump with the collecting conduit and is disposed in the V-shaped space.

DETAILED DESCRIPTION OF THE PREFERRED EMBODIMENT

Figure 1:
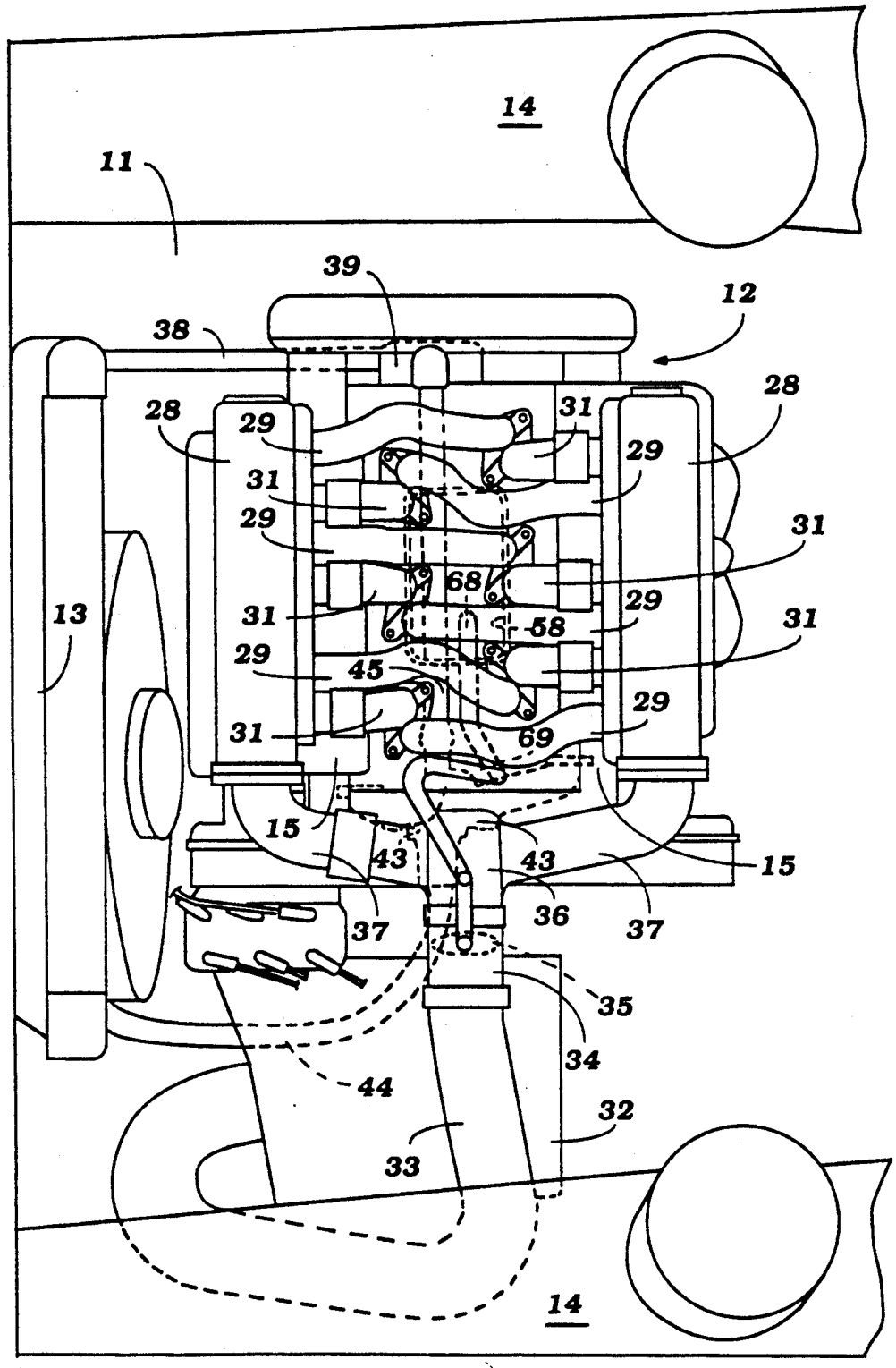
FIG. 1 is a top plan view showing the guide engine compartment of a motor vehicle powered by an internal combustion engine constructed in accordance with an embodiment of the invention.

Referring first to FIG. 1, an engine compartment of a motor vehicle is identified generally by the reference numeral 11. Positioned within the engine compartment 11 in a transverse location is an internal combustion engine, indicated generally by the reference numeral 12. The engine 12 is disposed with its output shaft extending transversely and is positioned to the rear of a cooling radiator 13 and between the fender aprons 14. The engine 12 drives a pair of front wheels (not shown) in any suitable manner as is normally employed with this type of engine placement.

Referring now additionally to the remaining figures, the engine 12 includes a cylinder block, indicated generally by the reference numeral 14. The engine 12 is of the V-type and to this end the cylinder block 14 is provided with a pair of angularly related cylinder banks 15. Each of the cylinder banks 15 is formed with a plurality of cylinder bores 16 each of which slidably supports a respective piston 17. The pistons 17 are connected by means of connecting rods 18 to a crankshaft 19. The crankshaft 19 is rotatably journaled within the cylinder block 14 in a known manner, as by means of journals 21.

The cylinder block 14 is provided with a lower flange 22 to which an oil pan or crankcase 23 is affixed, as by bolts 24. The oil pan 23 cooperates with a lower wall 25 of the cylinder block 14 so as to define a crankcase chamber 26. Lubricant is received within the crankcase chamber 26, but the lubricant does not extend above the oil pan 23 so that there is an air volume over the lubricant for ventilating purposes.

A respective cylinder head 27 is affixed to each of the cylinder banks. The cylinder head 27 forms combustion chambers with the cylinder bores 16 and piston 17, and an appropriate valve mechanism is provided for admitting an intake charge into each of these combustion chambers and for discharging the burnt charge from the chambers. Since the invention is not concerned with the combustion, chambers, neither them nor the valve mechanism associated with them have been illustrated.

The engine 12 is provided with an induction system of the type illustrated and described in the co-pending application entitled "Intake Means Of Internal Combustion Engine", Ser. No. 634,795, Filed July 26, 1984 now U.S. Pat. No. 4,649,876, and assigned to the Assignee of this application. To this end, there are provided a pair of plenum chambers 28 each of which lies over a respective of the cylinder heads 27. Each plenum chamber has a plurality of long runners 29 that extends across the engine to an inlet port of the opposite cylinder bank and a short runner 31 that extends to an inlet port of the adjacent cylinder bank. Noted in co-pending application Ser. No. 634,795, the runners 29 and 31 are tuned so as to provide good performance throughout the entire engine speed and load ranges.

Air is delivered to the respective plenum chambers 28 from an air intake and air filter assembly 32 that is positioned at one end of the engine (FIG. 1). A conduit 33 extends from the air cleaner 32 to an air inlet device 34 in which a single manually operated throttle valve 35 is positioned for controlling the air flow. Downstream of the air inlet device 34, there is provided a distribution device 36 that has a pair of runners 37 which deliver air to the individual plenum chambers 28.

The engine 12 is provided with a cooling system which receives coolant from the radiator 13 through a coolant intake pipe 38. The intake pipe 38 delivers the coolant to an engine driven coolant pump 39 which circulates the engine coolant through a cooling jacket 41 which encircles the cylinder bores 16 and also through similar cooling jackets formed in the cylinder heads 27. The coolant is then discharged through discharge system comprised of a Y type having pair of branches 42 each of which receive coolant from a respective one of the cylinder heads for discharge to a coolant outlet pipe 43 and, in turn, back to the radiator 13 through a coolant return conduit 44. There is further provided a bypass passage 45 that extends from the coolant pump 39 to the return pipe 43 for return to the radiator until the engine has heated sufficiently so as to necessitate full coolant circulation.

Figure 2:
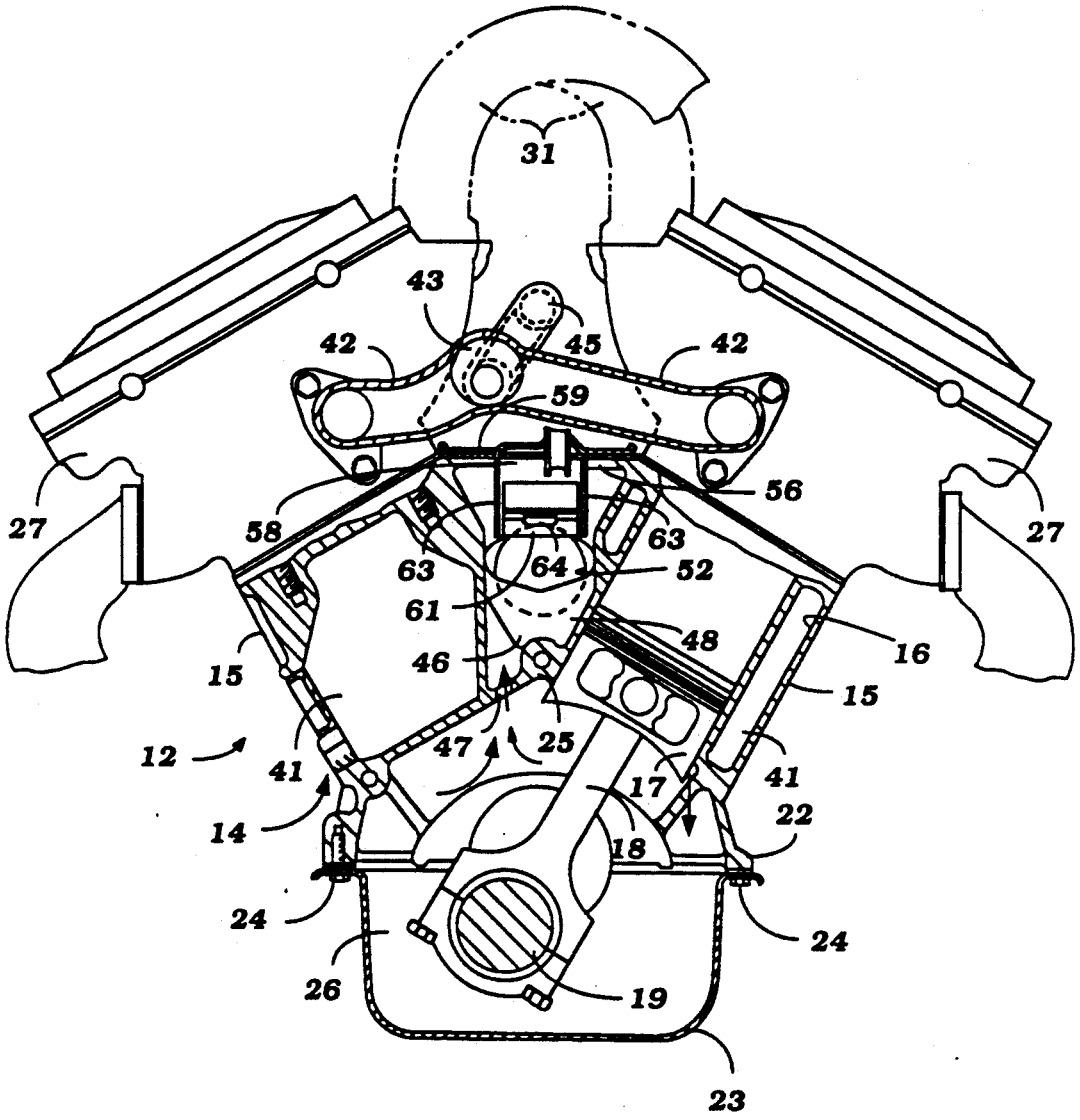
FIG. 2 is a front elevational view of the engine, with portions broken away and other portions shown in sections.
Figure 3:
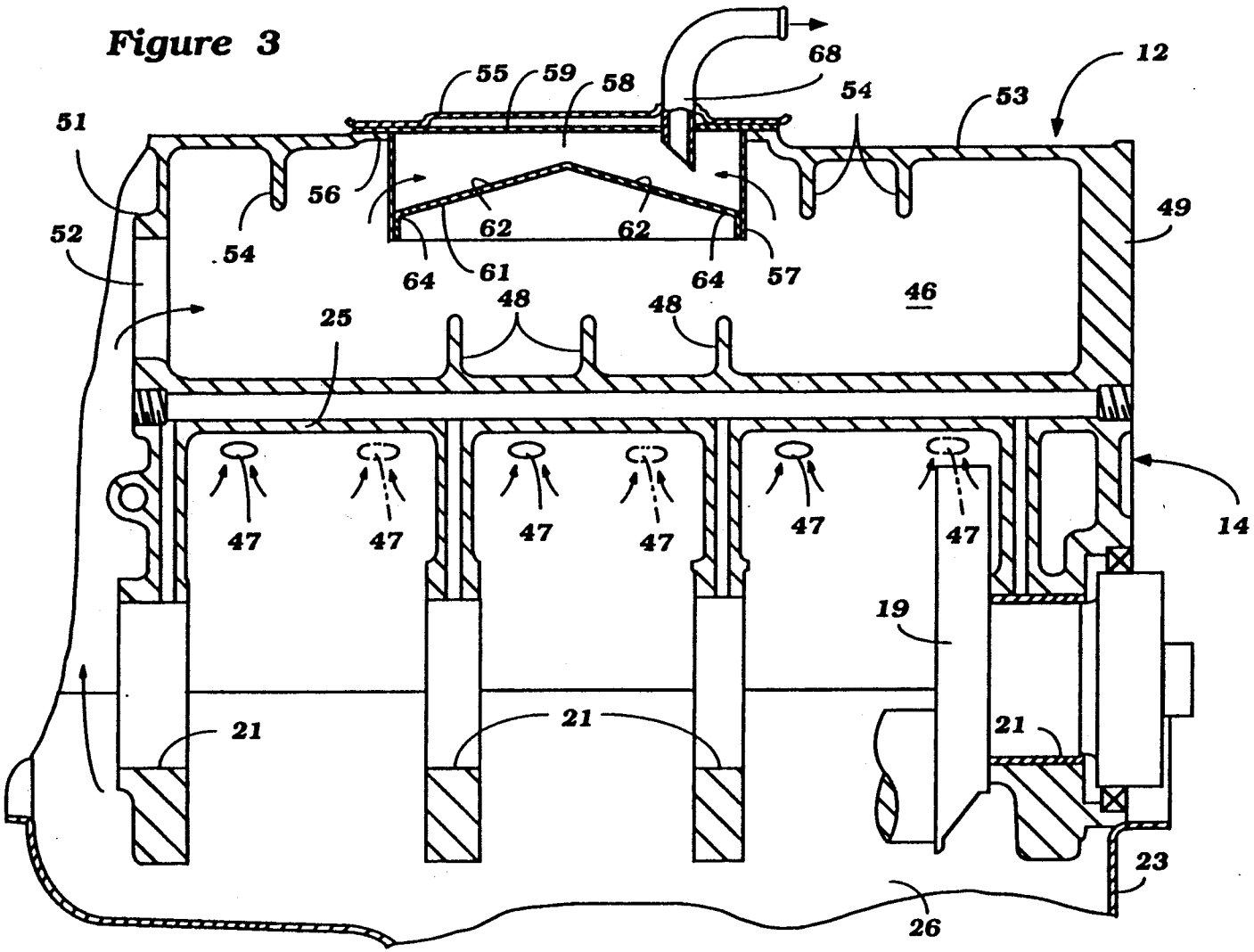
FIG. 3 is a longitudinal, cross-sectional view taken through the engine.
Figure 4:
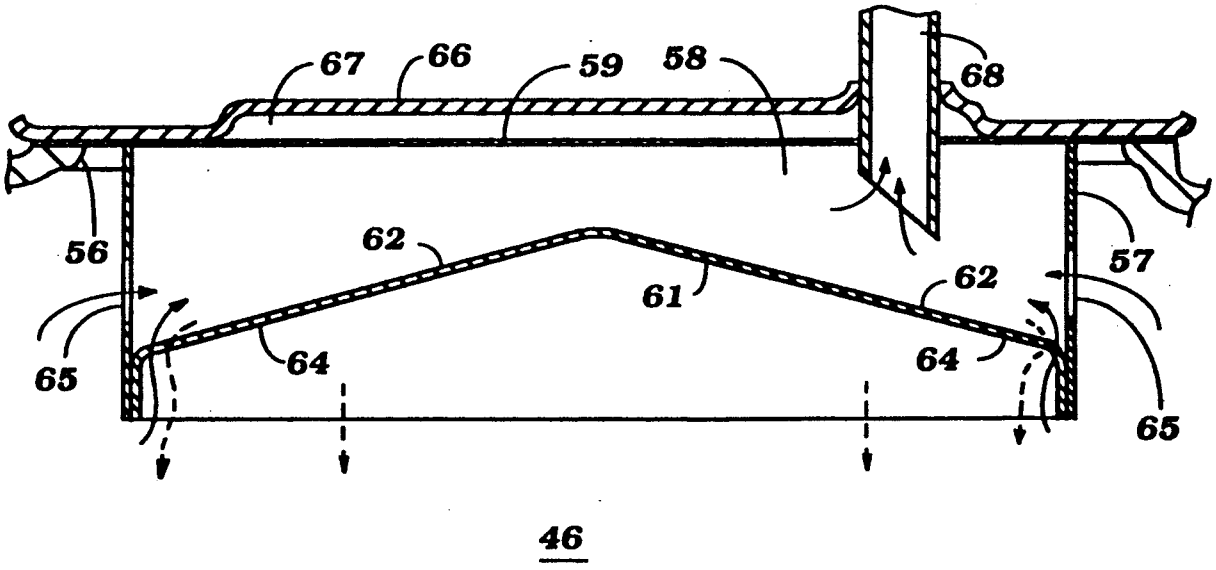
FIG. 4 is an enlarged cross-sectional view, taken along the same plane as FIG. 3, showing the details of the oil separator.

As has been previously noted, the crankcase chamber 26 is provided with an air space over the lubricant for crankcase ventilation. The flow of ventilating air is shown in FIGS. 2 through 4, and it may be seen that the ventilating air passes upwardly into a valley 46 formed between the cylinder banks 15 through a plurality of longitudinally spaced openings 47 formed in the lowermost portion of the cylinder block wall 25. Wall 25 is provided with a plurality of upstanding ribs 48 that will aid in cooling and which will also promote a better air flow through the valley 46.

The valley 46 is further closed at one end by an end wall 49 and at the opposite end by an end wall 51. The end wall 51 has a flow opening 52 so that crankcase gases may flow through this area also as shown in FIG. 3. Upper end of the valley chamber 46 is closed by a top wall 53 of the cylinder block 14. Depending ribs 54 extend into the chamgber 46 so as to promote cooling and also to move the airflow through the chamber 46.

The crankcase gases are discharged through a separator, indicated generally by the reference numeral 55. The seperator 55 is formed from a plurality of pieces of sheet metal that are connected together and extends through an opening 56 formed in the top wall. The separator 55 comprises a main body portion that is comprised of a generally rectangular-shaped side wall part 57 which defines an internal cavity 58. A top cover plate 59 closes the upper end of the cavity 58. A lower baffle plate 61 partially closes the lower wall of the cavity 59 and has a generally inverted V-shape in cross-section as shown in FIGS. 3 and 4. This shape is made up of a pair of downwardly diverging parts 62 that have their apex at the center of the cavity 58.

As may be seen in FIG. 2, the baffle plate 61 does not extend completely across the width of the cavity 62, so there are spaced gaps 63 formed on the opposite sides which permit air flow in upward direction and the return of condensed liquid back to the crankcase in a lower direction. In addition, there are formed openings 64 at the front and rear sides of the baffle plate 61 where it joins the sidewalls 57 for air flow in an upward direction and condensed oil flow in the downward direction. Adjacent portions of the side wall 57 are also provided with airflow openings 65. The airflow openings 65 are positioned vertically above the baffle plate 62 so no condensed liquid can return to the crankcase through them.

Cover plate 66 overlies the cover plate 59 and defines an air gap 67 therebetween for insulating purposes.

A crankcase ventilating gas air outlet 68 extends through the cover plates 66 and 59 and opens into the cavity 58 for receipt of the crankcase gases from which condensed liquid have been separated. Crankcase discharge pipe 68 communicates with a conduit 69 that delivers the crankcase ventilating gases to the induction system.

It should be readily apparent from the foregoing description that the oil separator is extremely compact in nature, and yet is highly effective in returning condensed liquid back to the crankcase of the engine. Although an embodiment of the invention has been illustrated and described, various changes and modifications may be made without departing from the spirit and scope of the invention as defined by the appended claims.

We claim:

1. A coolant passage system for a V-shaped internal combustion engine having a crankshaft, a radiator, and a pair of cylinder banks having respective coolant jackets defined therein, and a V-shaped space defined between said cylinder banks said system comprising a coolant pump disposed at one end of said cylinder banks in the direction of said crankshaft and delivering coolant into said coolant jackets at said one end of said engine from said radiator; a collecting conduit disposed on an opposite end of said cylinder banks for delivering the coolant from said coolant jackets to said radiator; a bypass pipe interconnecting said coolant pump and said collecting conduit and disposed in said V-shaped space.

2. A coolant passage system for a V-shaped internal combustion engine as set forth in claim 1 wherein the bypass pipe permits flow from the coolant pump to the collecting conduit until the temperature of the engine reaches a predetermined level.

3. A coolant passage system for a V-shaped internal combustion engine as set forth in claim 1 wherein the engine is disposed transversely in the engine compartment and the crankshaft rotates about an axis that is generally parallel to the radiator.

4. A coolant passage system for a V-shaped internal combustion engine as set forth in claim 3 further including first conduit means extending from one end of the engine and interconnecting the coolant pump with the radiator and second conduit means extending from the other end of the engine and interconnecting the collecting conduit with the radiator.

5. A coolant passage system for a V-shaped internal combustion engine as set forth in the claim 4 wherein the radiator is of the cross flow type and the first conduit means extends to one side of the radiator and the second conduit means extends to the other side of the radiator.

* * * * *